US011466418B2

(12) United States Patent
Sankovic

(10) Patent No.: US 11,466,418 B2
(45) Date of Patent: Oct. 11, 2022

(54) ADJUSTABLE SNOWPLOW

(71) Applicant: Meyer Products, LLC, Cleveland, OH (US)

(72) Inventor: Denis Sankovic, Euclid, OH (US)

(73) Assignee: Meyer Products, LLC, Cleveland, OH (US)

( * ) Notice: Subject to any disclaimer, the term of this patent is extended or adjusted under 35 U.S.C. 154(b) by 285 days.

(21) Appl. No.: 16/728,240

(22) Filed: Dec. 27, 2019

(65) Prior Publication Data

US 2020/0208364 A1 Jul. 2, 2020

Related U.S. Application Data

(60) Provisional application No. 62/785,927, filed on Dec. 28, 2018.

(51) Int. Cl.
*E01H 5/06* (2006.01)

(52) U.S. Cl.
CPC ..... *E01H 5/065* (2013.01)

(58) Field of Classification Search
CPC ..... E01H 5/06; E01H 5/061; E01H 5/065; E01H 5/066; E01H 5/067; E02F 3/815
See application file for complete search history.

(56) References Cited

U.S. PATENT DOCUMENTS 3,425,497 A * 2/1969 Strabala ..... E02F 3/764 172/792
3,807,064 A * 4/1974 Schmidt, Jr. ..... E01H 5/063 37/283
4,073,077 A * 2/1978 Essel ..... E01H 5/065 172/777
4,667,426 A * 5/1987 Howard ..... E01H 5/065 172/816
5,392,538 A * 2/1995 Geerligs ..... E01H 5/061 37/236
5,815,956 A 10/1998 Lavin
5,899,007 A * 5/1999 Niemela ..... E02F 3/8155 37/281
6,408,549 B1 * 6/2002 Quenzi ..... E01H 5/065 37/281
6,412,199 B1 * 7/2002 Quenzi ..... E01H 5/065 37/281
6,442,877 B1 * 9/2002 Quenzi ..... E01H 5/065 37/281

(Continued)

*Primary Examiner* — Jamie L McGowan
(74) *Attorney, Agent, or Firm* — Myers Wolin, LLC

(57) ABSTRACT

An adjustable snowplow is provided, the adjustable snowplow including a center blade and first and second wing blades each positioned on opposite ends of the center blade. A channel is provided along a back and length of the center blade. First and second wing bars are provided, attached to respective backs of the first and second wing blades, and configured to be slidably received within the channel for reciprocal movement. In this manner, the blades are moved inwardly toward or outwardly away from the center blade, thereby adjusting an overall width of the snowplow. The channel includes a cross-sectional shape defined by a plurality of surfaces. One or more gaps are respectively formed in one or more of the plurality of surfaces, to permit snow and water that would otherwise be trapped to fall and/or flow away from the adjustable snowplow.

15 Claims, 13 Drawing Sheets

(56) References Cited

U.S. PATENT DOCUMENTS

| | | | | |
|---|---|---|---|---|
| 7,578,078 | B2 * | 8/2009 | Gandolfi | E01H 5/066 172/815 |
| 7,658,022 | B2 * | 2/2010 | Strait | E01H 5/063 37/232 |
| 7,681,337 | B2 * | 3/2010 | Watson | E01H 5/065 37/281 |
| 8,607,482 | B2 * | 12/2013 | Bloxdorf | E01H 5/065 37/274 |
| 8,875,419 | B2 | 11/2014 | Schmeichel | |
| 8,887,413 | B2 * | 11/2014 | Miller | E02F 3/8155 37/281 |
| 9,255,371 | B1 * | 2/2016 | Jordan | E01H 5/065 |
| 10,106,942 | B2 * | 10/2018 | Roberge | E01H 5/061 |
| 10,316,480 | B2 * | 6/2019 | Kemmerling | E01H 5/06 |
| 2009/0307943 | A1 * | 12/2009 | Buckbee | E01H 5/066 37/266 |
| 2013/0206433 | A1 * | 8/2013 | Miller | E02F 3/815 172/811 |
| 2015/0040441 | A1 * | 2/2015 | Nammensma | E01H 5/068 37/268 |
| 2017/0226711 | A1 * | 8/2017 | Roberge | E01H 5/061 |

* cited by examiner

ADJUSTABLE SNOWPLOW

This application claims the benefit of U.S. Provisional Application No. 62/785,927, entitled ADJUSTABLE SNOWPLOW, filed Dec. 28, 2018, which is fully incorporated herein by reference.

I. BACKGROUND

A. Field of the Invention

The present invention relates to an apparatus and method for snow removal. More particularly, the present invention is directed to a snowplow whose working width can be adjusted to accommodate various sized areas in need of snow removal.

B. Description of Related Art

Snowplows are frequently used as snow removal devices in the winter months in cold climates. Snow removal is often desirable for people to be able to travel efficiently. Sometimes entities will need to keep several different sized snow plows in their equipment inventory to accommodate various sized jobs, such as driveways, parking lots, streets, and sidewalks. This is disadvantageous, as each snow plow has associated costs including the purchase price, maintenance and storage.

In addition, there are various types of snowplows. Most snowplows will displace snow to the side, so the result is that there is a pile of plowed snow that is parallel to the direction of travel of the plow. Other types of snow removal apparatuses, sometimes called "containment plows," capture the snow and transport it without the transverse displacement associated with "straight blade plows."

While adjustable snowplows generally work well for their intended purposes they are known to have disadvantages. FIG. 1 is a back perspective view of a known adjustable snowplow 10 that includes a center blade 12 and a pair of wing blades 14, 16 positioned on opposite ends of the center blade 12. A hollow channel 18 is attached to the back of the center blade 12 and receives wing bars 20, 22 attached to the back of the wing blades 14, 16, respectively. The width 24 of the snowplow 10 can be adjusted by moving either (or both) of the wing blades 14, 16 with respect to the center blade 12 as the corresponding wing bars 20, 22 slide within the channel 18.

Note, however, that the channel 18 is fixedly attached to the center blade 12 along its entire length. Note also that the top of the channel 18 is a continuous surface. Similarly, each wing bar 20, 22 is fixedly attached to the corresponding wing blade 14, 16 along its entire length and each wing bar's top surface is a continuous surface. As a result, during use of the snowplow 10 snow accumulates on top of the channel 18 and against the back surface of the center blade 12 as well as on top of the wing bars 20, 22 and against the back surfaces of the wing blades 14, 16. This snow accumulation adds unwanted weight to the snowplow 10 and creates a rust-likely environment.

What is needed is an adjustable snowplow that eliminates or greatly reduces the disadvantages described above.

II. SUMMARY

Provided in this disclosure is an adjustable snowplow, including a center blade and first and second wing blades each positioned on opposite ends of the center blade. A channel is provided running longitudinally along a back of the center blade, substantially along a length of the center blade. First and second wing bars are provided, attached to respective backs of the first and second wing blades. The first and second wing bars are configured to be slidably received within the channel for reciprocal movement. In this manner, one or both of the first and second wing blades are moved inwardly toward the center blade or moved outwardly away from the center blade, thereby adjusting the overall width of the snowplow. One or more attachment components are provided for attaching the center blade to a vehicle.

The channel includes a cross-sectional shape defined by a plurality of surfaces. One or more gaps are respectively formed in one or more of the plurality of surfaces, to permit snow and water that would otherwise be trapped to fall and/or flow away from the adjustable snowplow.

In one exemplary embodiment, the center blade and the first and second wing blades include wingtips to engage a road surface or other surface being plowed by the snowplow. In another exemplary embodiment, one or both of the first and second wing bars is moved by a respective cylinder operated to extend and retract a respective piston rod that is engaged to a respective first wing bar. The cylinder(s) can be hydraulic or pneumatic cylinders.

In yet another exemplary embodiment, one or more support brackets are attached to the back of the center blade. The support brackets extend generally vertically and rearwardly away from a back surface of the center blade and the first and second wing blades. The support brackets are connected between the center blade and the channel, thereby defining a second gap between the back of the center blade and the channel. The second gap permits snow and water to fall and/or flow downward and away from the adjustable snowplow.

In still another exemplary embodiment, the cross-sectional shape of the channel is a generally rectangular cross-sectional shape defined by four surfaces formed by four members, a top front member, a top back member, a bottom front member, and a bottom back member. The cross-sectional shape is defined by a top surface, a bottom surface, a front surface and a back surface formed by the four members. One or more gaps are formed in at least one of these surfaces between at least two of the four members.

In a further exemplary embodiment, the gaps include one or more of the following gaps: a top gap formed in the top surface between the top front member and the top back member; a bottom gap formed in the bottom surface between the bottom front member and the bottom back member; a front gap formed in the front surface between the top front member and the bottom front member proximate to the center blade; and a back gap formed in the back surface between the back top member and the back bottom member opposite the center blade. The top gap, the bottom gap, the front gap, and the back gap permit snow and water to fall and/or flow away from the adjustable snowplow.

In another further exemplary embodiment, the four members of the channel are L-shaped angle iron components. The first and second wing bars are hollow with a generally rectangular cross-sectional shape respectively having four sides. One or more of the four sides of the rectangular cross-sectional shape include one or more openings to permit snow and water to fall and/or flow away from the adjustable snowplow.

In yet another further exemplary embodiment, the adjustable snowplow includes one or more support arms for interconnecting one or both of the first and second wing blades to a respective one of the first and second wing bars. A relatively inner support arm can be shorter than a relatively outer support arm so that the first and second wing blades are at an angle with respect to the center blade. The adjustable snowplow can also include open spaces between the relatively inner support arm and the relatively outer support arm, to provide additional space to permit snow and water to fall and/or flow away from the adjustable snowplow.

Other benefits and advantages of this invention will become apparent to those skilled in the art to which it pertains upon reading and understanding of the following detailed specification.

BRIEF DESCRIPTION OF THE DRAWINGS

The invention may take physical form in certain parts and arrangement of parts, embodiments of which will be described in detail in this specification and illustrated in the accompanying drawings which form a part hereof and wherein.

IV. DETAILED DESCRIPTION

Figure 1:
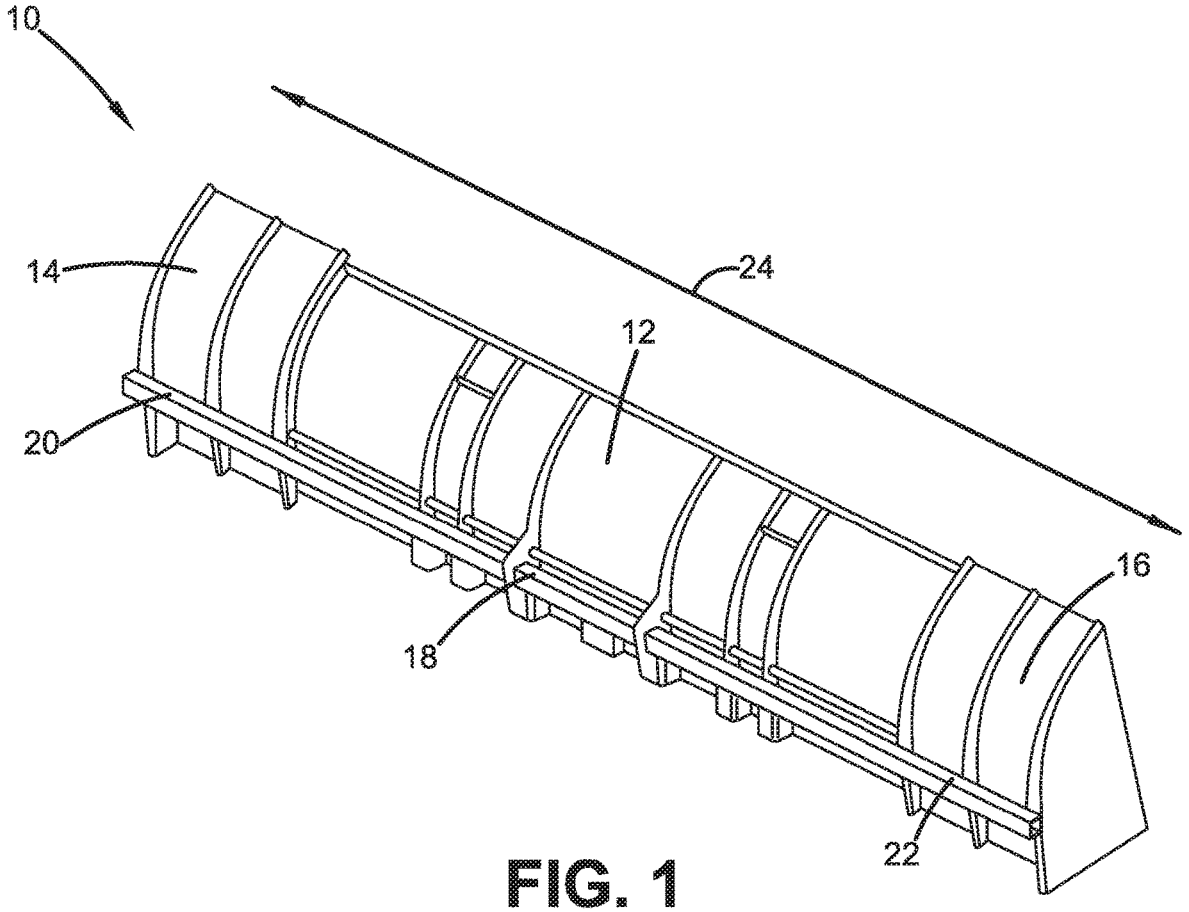
FIG. 1 Prior Art
FIG. 1 is a back perspective view of a known adjustable snowplow.

Referring now to the drawings wherein the showings are for purposes of illustrating embodiments of the invention only and not for purposes of limiting the same, and wherein like reference numerals are understood to refer to like components, FIGS. 2-8 show an adjustable snowplow 100 according to some embodiments of this invention. The adjustable snowplow 100 may include a center blade 102 and a pair of wing blades 104, 106 including a first wing blade 104 and a second wing blade 106 positioned on opposite ends of the center blade 102. The first and second wing blades 104, 106 are adjustable and can be drawn inwardly toward the center blade 102 or moved outwardly away from the center blade 102.

A channel 108 may be attached to the back of the center blade 102. The channel 108 runs longitudinally along the back of the center blade 102, substantially along the length of the center blade 102. The channel 108 is shaped to slidably receive first and second wing bars 110, 112 that may be attached to the backs of the first and second wing blades 104, 106, respectively. The first and second wing bars 110, 112 are shaped to be received within the channel 108 for reciprocal movement inwardly and outwardly with respect to the center blade.

The overall width 114 of the snowplow 100 (FIG. 5) may be adjusted by moving either (or both) of the wing blades 104, 106 with respect to the center blade 102 as the corresponding first and second wing bars 110, 112 slide within the channel 108. The first and second wing bars 110, 112 slide inwardly along the channel 108 to move the respective first and second wing blades 104, 106 inwardly along the center blade 102, thereby reducing the width of the snowplow 100. Conversely, the first and second wing bars 110, 112 slide outwardly along the channel 108 to move the respective first and second wing blades 104, 106 outwardly along the center blade 102, thereby increasing the width of the snowplow 100.

Figure 2:
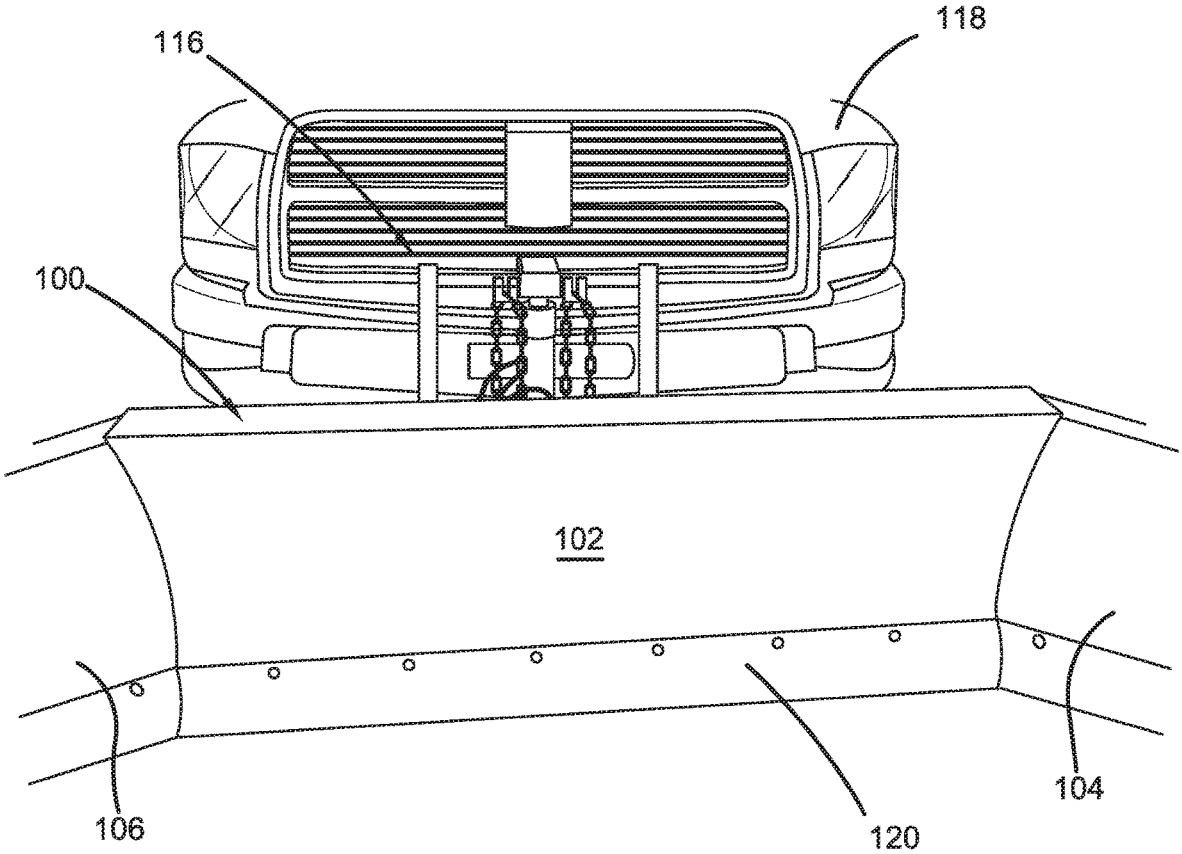
FIG. 2 is a front view of an adjustable snowplow according to embodiments of this invention.
Figure 3:
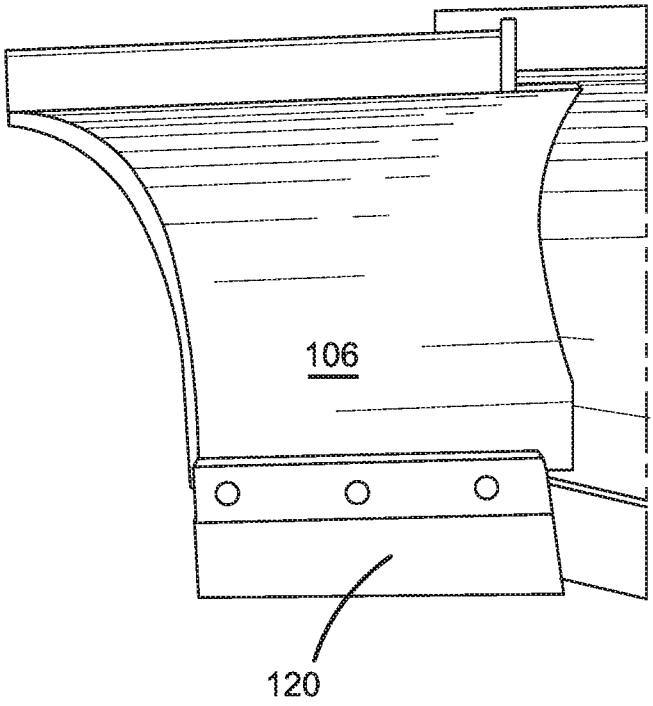
FIG. 3 is a front view of the right wing of an adjustable snowplow according to some embodiments of this invention.
Figure 4:
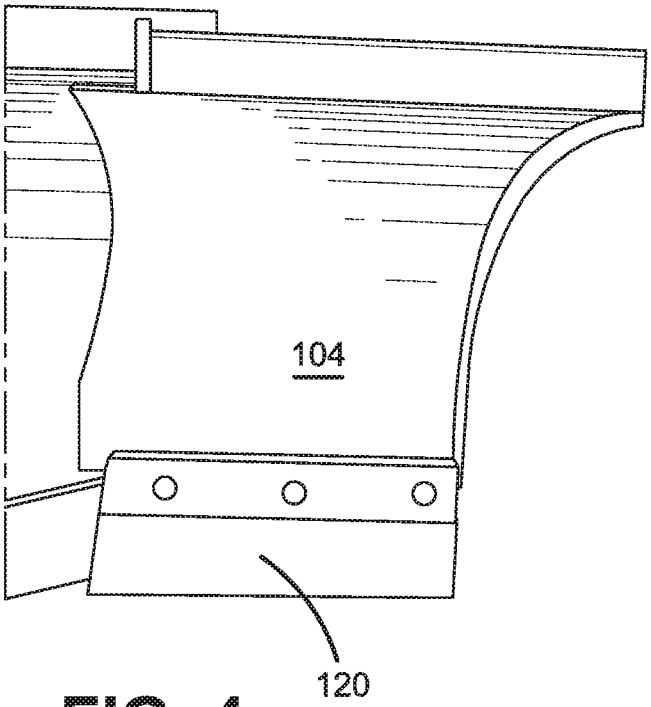
FIG. 4 is a front view of the left wing of an adjustable snowplow according to some embodiments of this invention.
Figure 5:
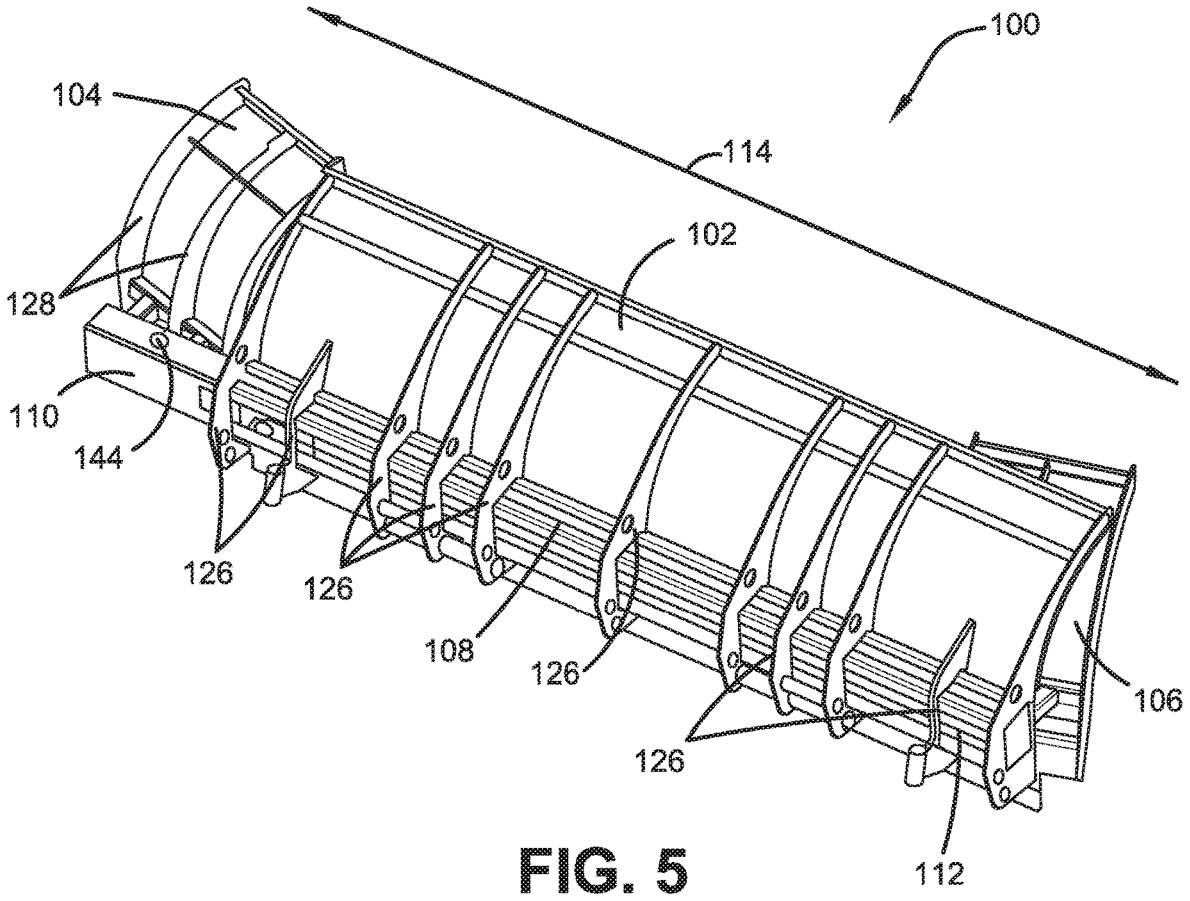
FIG. 5 is a back perspective view of an adjustable snowplow according to some embodiments of this invention.
Figure 6:
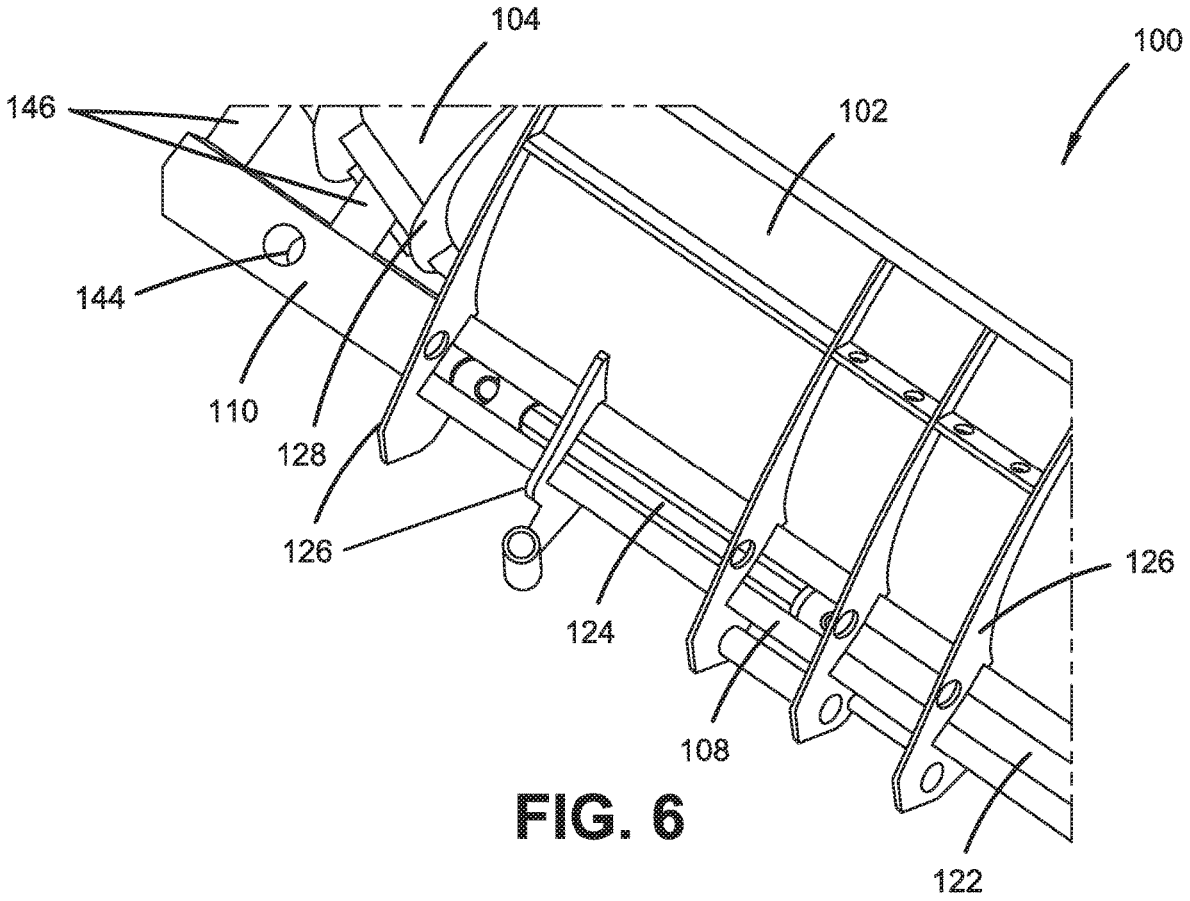
FIG. 6 is a top view of a portion of the adjustable snowplow shown in FIG. 5.
Figure 7:
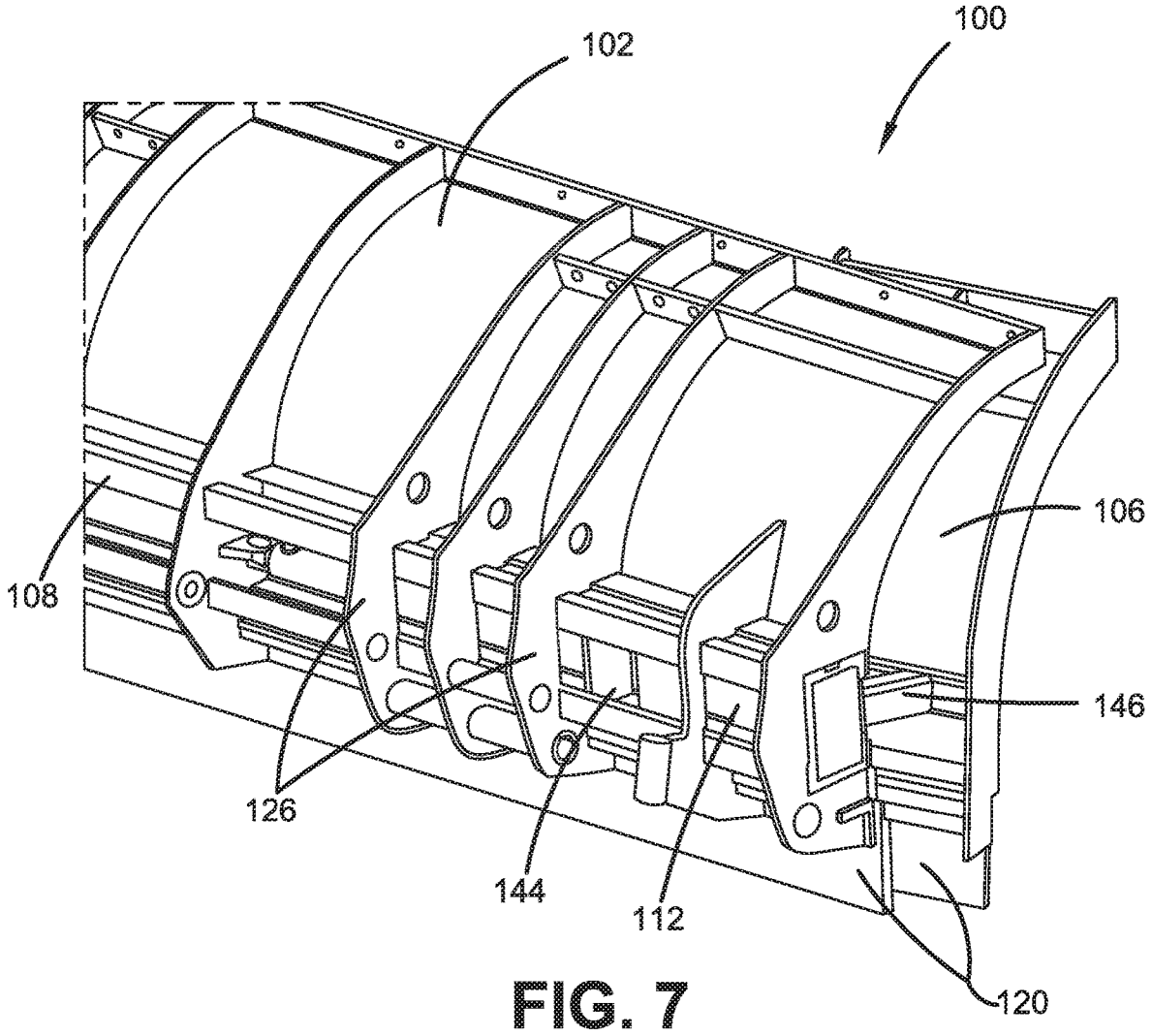
FIG. 7 is a back perspective view of the right side of the adjustable snowplow shown in FIG. 5.
Figure 8:
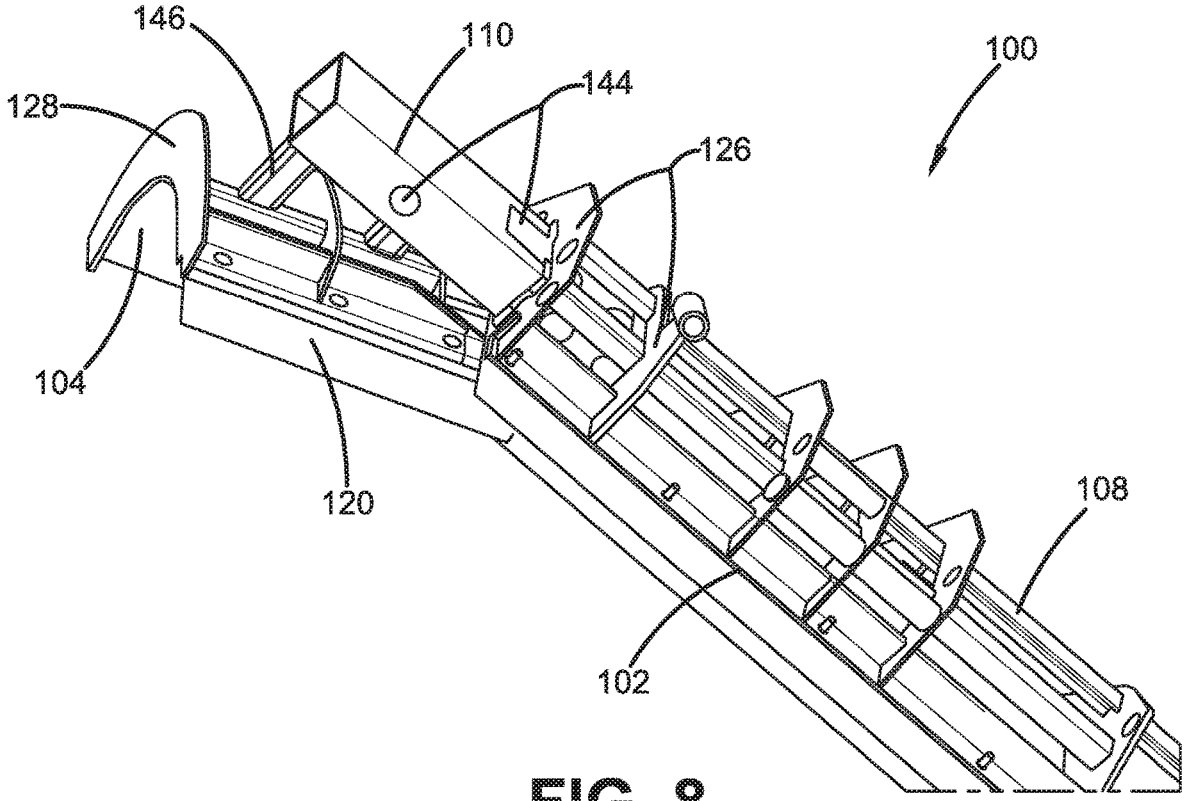
FIG. 8 is a bottom view of the left side of the adjustable snowplow shown in FIG. 5.
Figure 9:
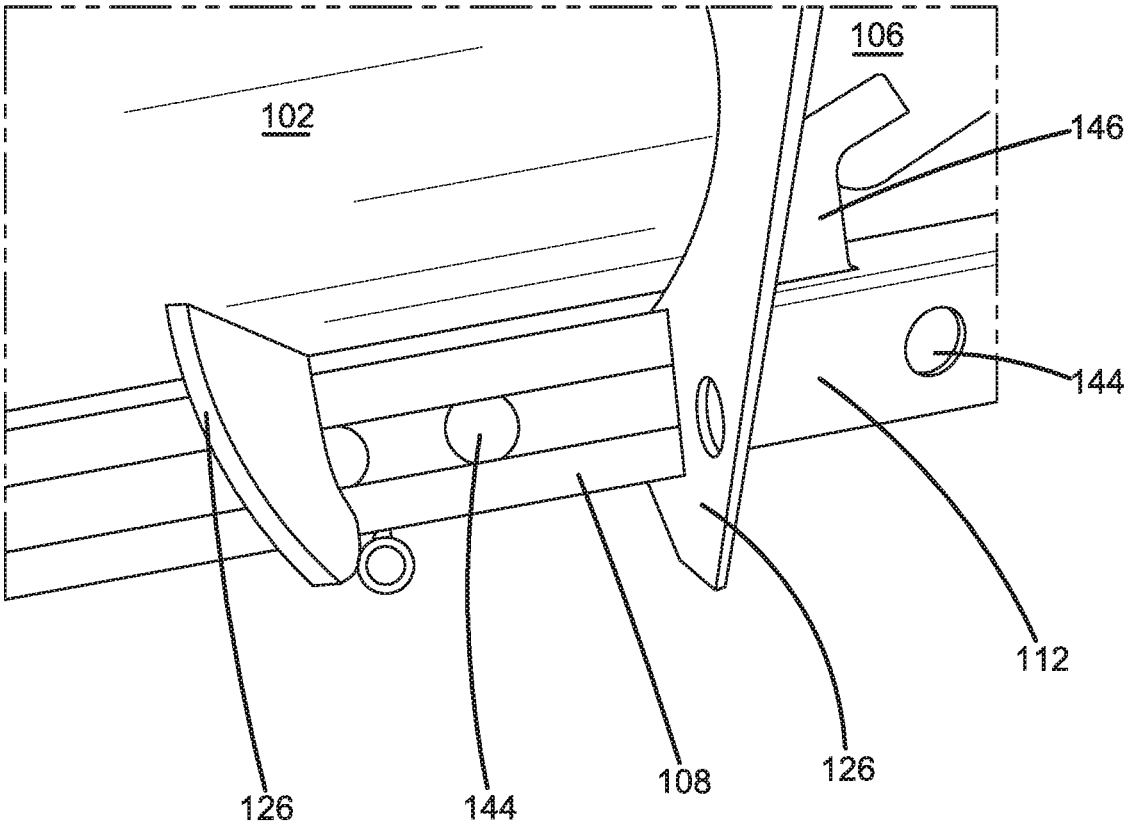
FIG. 9 is a top view of a portion of a snowplow according to some embodiments of this invention.
Figure 10:
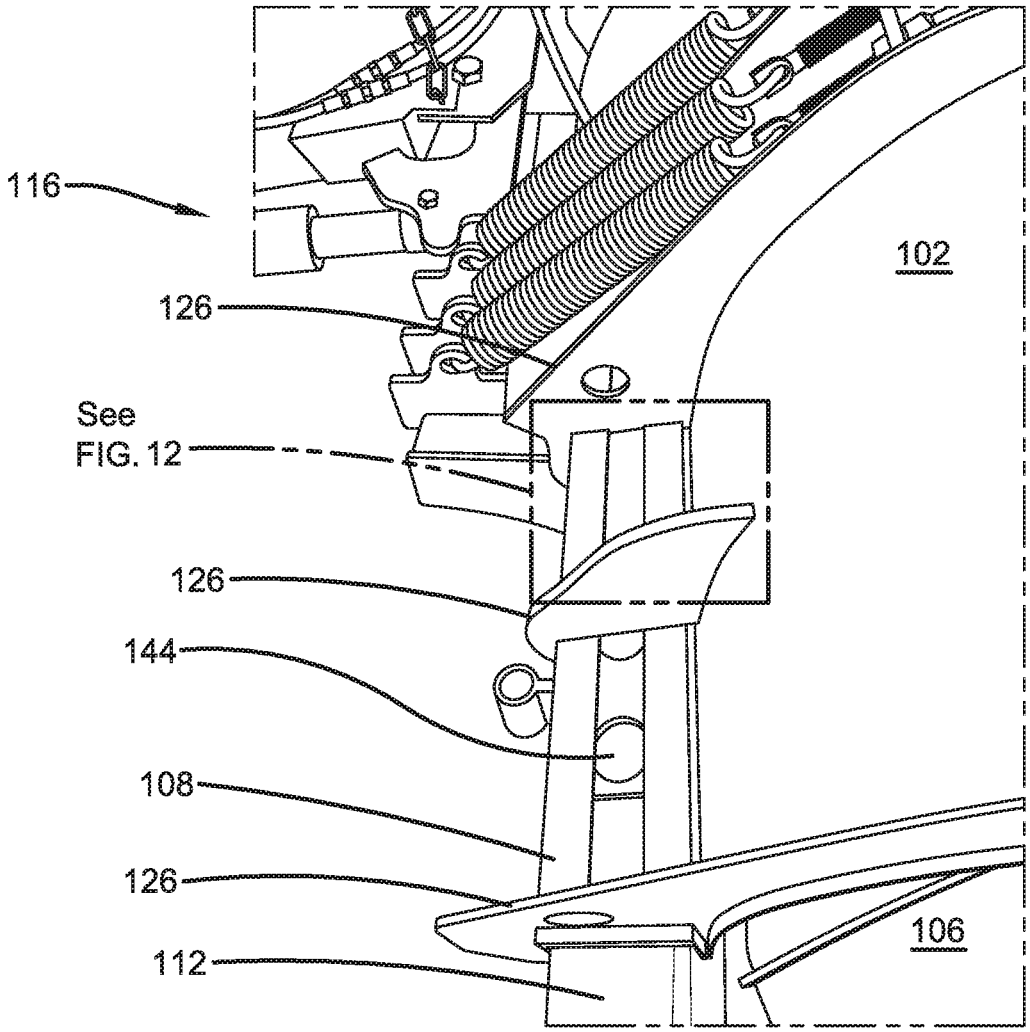
FIG. 10 is a top side perspective view of the snowplow shown in FIG. 9.
Figure 11:
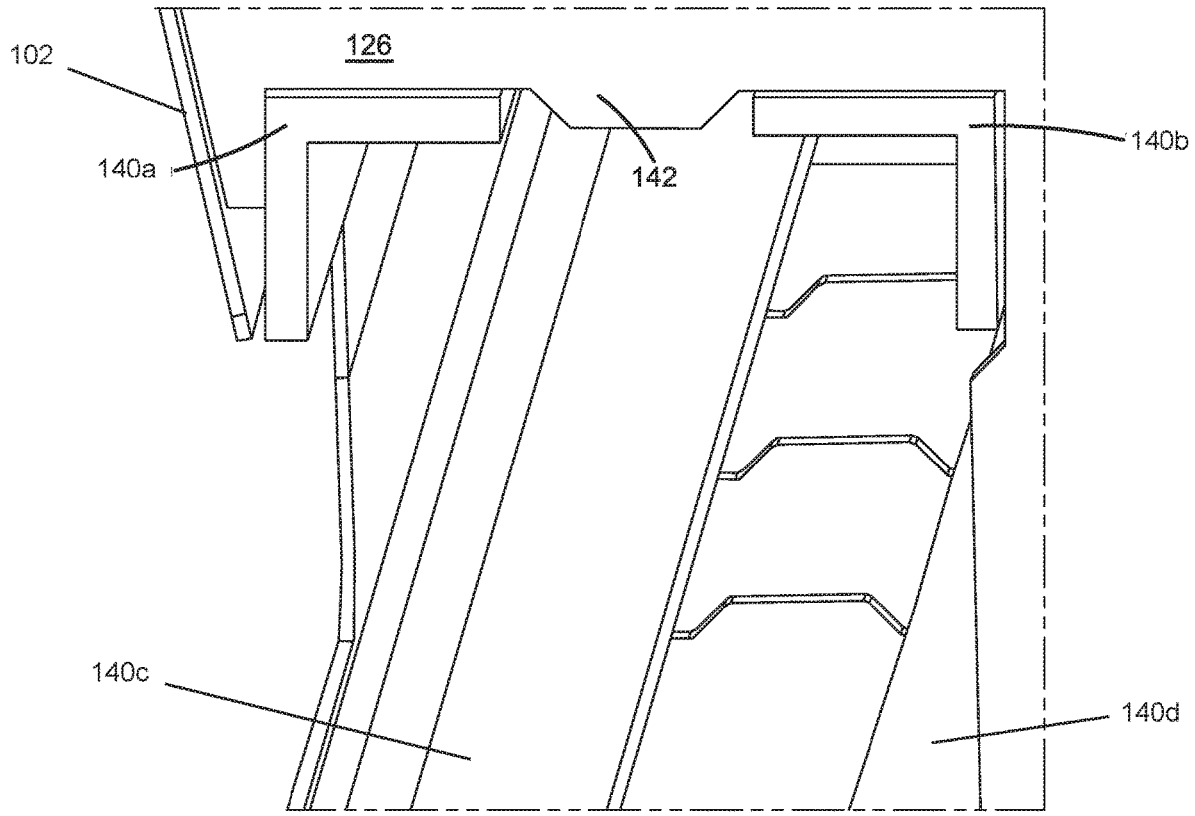
FIG. 11 is a detailed view of a portion of the channel according to some embodiments of this invention.

The center blade 102 may include attachment components 116 (see also FIG. 10) used to attach the snowplow 100 to a vehicle 118 (see FIG. 2). The attachment components 116 may be of any type chosen by a person of ordinary skill in the art and may be used to attach/detach the snowplow 100 to/from the vehicle 118. The attachment components 116 may also be used, in some embodiments, to raise and lower the snowplow 100 and/or to adjust the angle of the snowplow 100. As such attachment components 116 are well known to those of skill in the art, further details will not be provided here.

The center blade 102 and the first and second wing blades 104, 106 may be of any design chosen with the sound judgment of a person of skill in the art. They may, for example, include wingtips 120 designed to engage a road surface or other surface being plowed by the snowplow 100. In some embodiments the first and second wing blades 104, 106 may be manually position adjustable with respect to the center blade 102. In other embodiments a power source may be used to position adjust the wing blades 104, 106.

In one specific embodiment (see FIG. 6) a cylinder 122 may be operated to extend and retract a piston rod 124 that is engaged to the first wing bar 110 in a known manner (with a respective structure corresponding to the second wing bar 112). In some embodiments the cylinder 122 may be a hydraulic cylinder and in other embodiments it may be a pneumatic cylinder. As the operation of cylinders is well known to those of skill in the art, further details will not be provided here.

With reference now to FIGS. 5-14, one or more support brackets 126 may be attached to the backside of the center blade 102 as shown. The support brackets 126 may extend generally vertically and rearwardly away from the back surface of the center blade 102. Similarly, one or more support brackets 128 may be attached to the back side of the first and second wing blades 104, 106 as shown. The support brackets 126, 128 may be attached to the corresponding blades in any manner chosen with the sound judgment of a person of skill in the art. For the embodiments shown these attachments are welds.

The support brackets 126, 128 may have different heights and may extend rearward different amounts, as shown. This enables the support brackets 126, 128 to serve not only as structural reinforcement for the blades but also to serve as connecting structures to other components. The support brackets 126, for example, may be used to attach the center blade 102 (and thus the snowplow 100) to components 116 to interconnect the snowplow 100 to the vehicle 118. The support brackets 126 may also be used to attach the center blade 102 to the channel 108.

Figure 12:
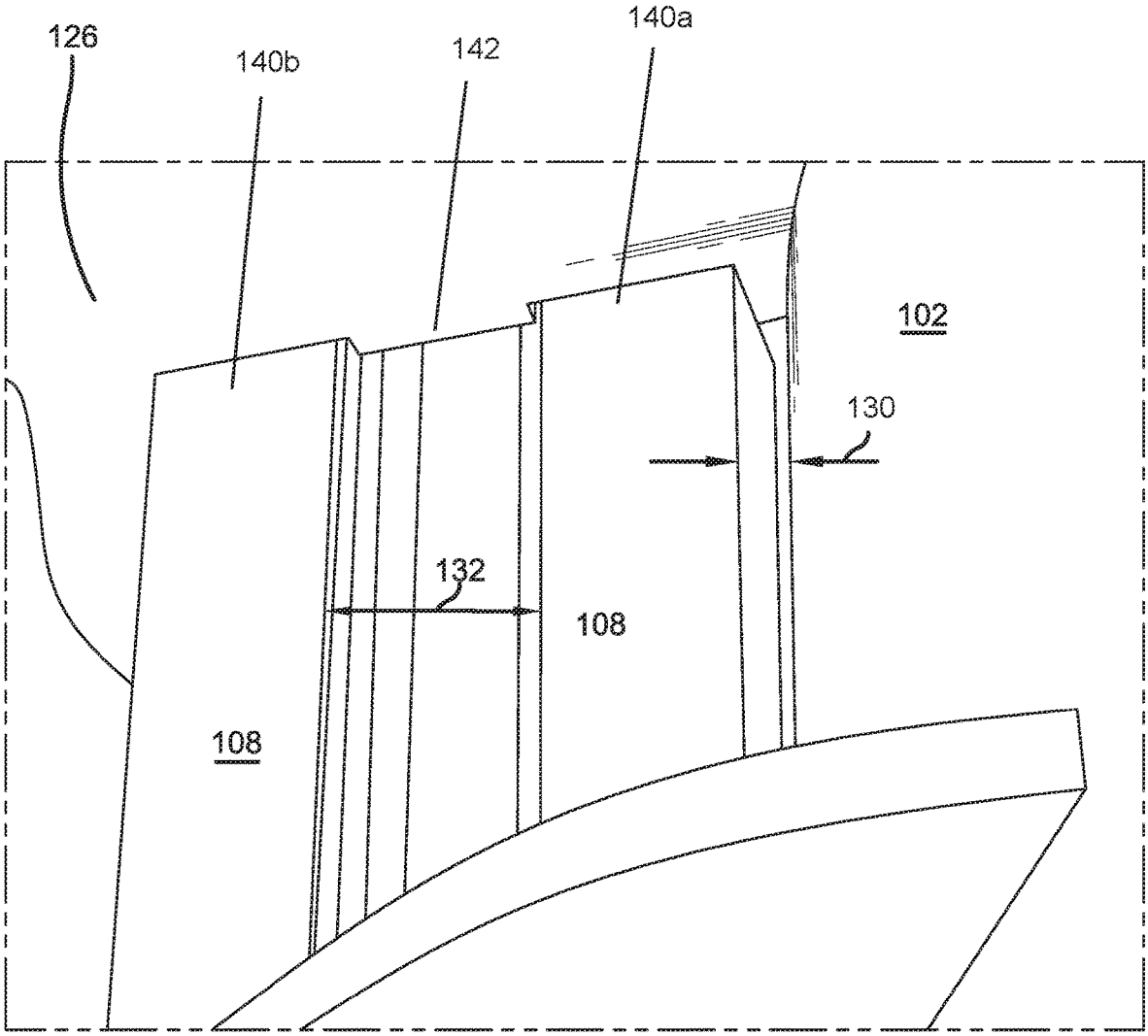
FIG. 12 is a detailed view of the callout indicated in FIG. 10.
Figure 13:
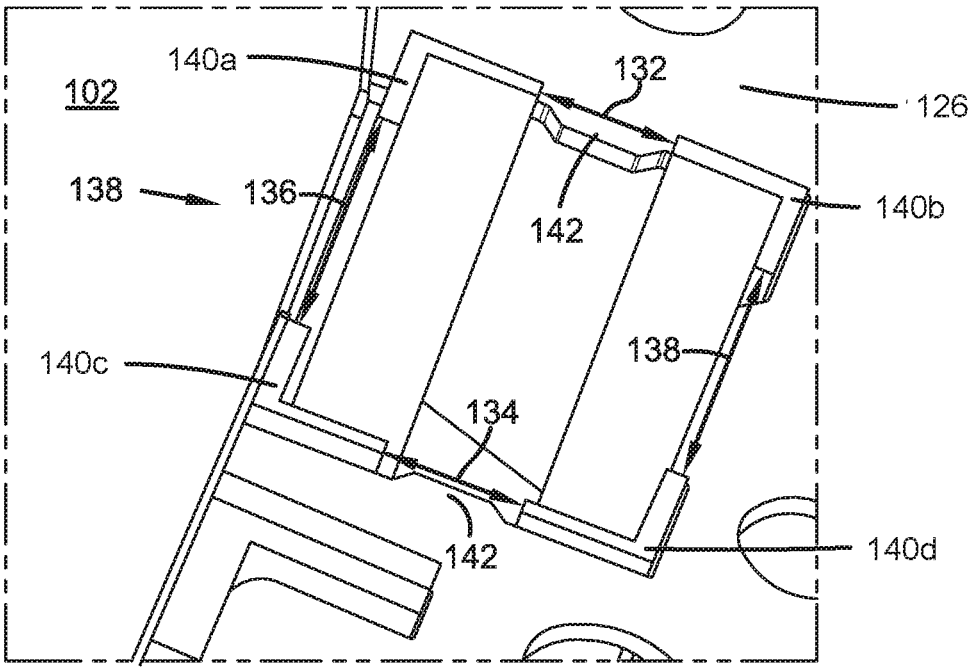
FIG. 13 is a detailed view of a portion of the channel according to some embodiments of this invention.
Figure 14:
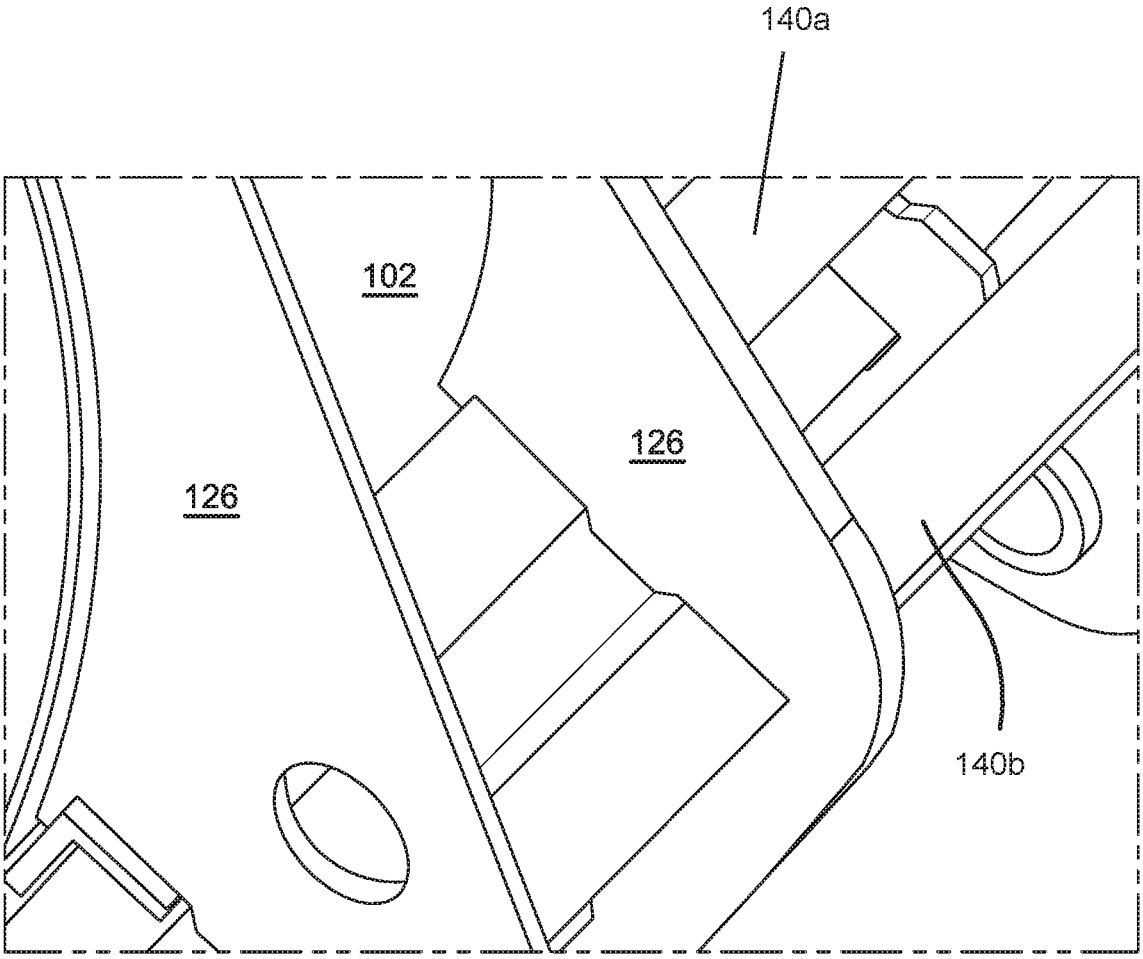
FIG. 14 is a detailed view of a portion of the channel according to some embodiments of this invention.

With the channel 108 attached to the support brackets 126, it is not necessary for the channel 108 to be directly attached to the center blade 102. As a result, there is a gap 130 (see FIG. 12) between the back surface of the center blade 102 and the channel 108. This gap 130 permits snow and water that would otherwise be trapped on the snowplow 100 to fall and/or flow downward and away. As also shown in FIG. 12, note that the upper surface of the channel 108 may not be continuous as in the prior art but instead may have at least one gap 132.

In some embodiments (as seen best in FIGS. 11, 12 and 13) the channel 108 may have a generally rectangular cross-sectional shape defined by four members—a top front member 140*a*, a top back member 140*b*, a bottom front member 140*c*, and a bottom back member 140*d*. There are respective top, bottom, front and back surfaces of the cross-sectional shape defined by these members 140*a*, 140*b*, 140*c*, 140*d*, with each of these surfaces having at least one gap between at least two of the four members 140*a*, 140*b*, 140*c*, 140*d*.

For the embodiment shown there is a top gap 132 in a top surface between the top front and top back members 140*a*, 140*b*. There is a bottom gap 134 in a bottom surface between the bottom front and bottom back members 140*c*, 140*d*. Similarly, there is a front gap 136 in a front surface between the top front and bottom front members 140*a*, 140*c* proximate to the center blade 102. Conversely, there is a back gap 138 in a back surface between the back top and back bottom members 140*b*, 140*d* opposite to the center blade 102. These gaps 132, 134, 136, 138 permit snow and water that would otherwise be trapped to fall and/or flow away. Moreover, the gaps allow the channel 108 to be open on four sides, thereby avoiding any compaction of snow and ice that might occur from any direction, further permitting snow and water to fall and/or flow away.

For the embodiment shown, the channel 108 is formed of the four members 140*a*, 140*b*, 140*c*, 140*d* which are preferably L-shaped angle iron components. The number and size of the gaps 130, 132, 134, 136, 138 can be any chosen with the sound judgment of a person of skill in the art. In some embodiments (seen best in FIGS. 11 and 13) the support brackets 126 may have one or more lips 142 that extend into one or more of the gaps 132, 134, 136, 138. This assists with the proper orientation in attachment of the angle iron components 140 *a*, 140*b*, 140*c*, 140*d* with the support brackets 126.

With reference now to FIGS. 5-10, the first and second wing bars 110, 112 may be hollow with a generally rectangular cross-sectional shape, as shown. One or more of the four sides of the rectangular cross-sectional shape may have one or more openings 144, as shown. These openings 144 permit snow and water that would otherwise be trapped to fall and/or flow away. The number and size of the openings 144 can be any chosen with the sound judgment of a person of skill in the art. One or more support arms 146 may interconnect the wing blades 104, 106 to the corresponding first and second wing bars 110, 112. In one embodiment (shown for example in FIG. 6) the relatively inner support arm 146 is shorter than the relatively outer support arm 146. As a result, the first and second wing blades 104, 106 are at an angle with respect to the center blade 102. Note also the open spaces between the support arms 146. This provides yet additional spaces that permit snow and water that would otherwise be trapped to fall and/or flow away.

Numerous embodiments have been described herein. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof. Further, the "invention" as that term is used in this document is what is claimed in the claims of this document. The right to claim elements and/or sub-combinations that are disclosed herein as other inventions in other patent documents is hereby unconditionally reserved.

I claim:

1. An adjustable snowplow, comprising:

a center blade and first and second wing blades each positioned on opposite ends of the center blade;

a channel running longitudinally along a back of the center blade, substantially along a length of the center blade;

first and second wing bars attached to respective backs of the first and second wing blades, wherein the first and second wing bars are configured to be slidably received within the channel for reciprocal movement so that at least one of the first and second wing blades are moved inwardly toward the center blade or moved outwardly away from the center blade, thereby adjusting an overall width of the snowplow;

at least one support bracket attached to the back of the center blade, wherein the at least one support bracket extends generally vertically and rearwardly away from a back surface of at least one of the center blade and the first and second wing blades;

wherein the channel comprises a cross-sectional shape defined by a plurality of surfaces, and further comprising at least one gap formed in at least one of the plurality of surfaces, to permit snow and water to fall and/or flow through the gap and away from the adjustable snowplow;

wherein the support brackets are connected between the center blade and the channel, thereby defining a second gab between the back of the center blade and the channel, wherein the second gap permits snow and water to fall and/or flow downward and away from the adjustable snowplow; and further comprising:

at least one attachment component for attaching the center blade to a vehicle.

2. The adjustable snowplow of claim 1, wherein the center blade and the first and second wing blades further comprise wingtips to engage a road surface or other surface being plowed by the snowplow.

3. The adjustable snowplow of claim 1, wherein at least one of the first and second wing bars is moved by at least one cylinder operated to extend and retract a respective piston rod that is engaged to a respective first wing bar, wherein the at least one cylinder is at least one of a hydraulic cylinder or a pneumatic cylinder.

4. The adjustable snowplow of claim 1, wherein the cross-sectional shape of the channel is a generally rectangular cross-sectional shape defined by four surfaces formed by four members comprising a top front member, a top back member, a bottom front member, and a bottom back member.

5. The adjustable snowplow of claim 4, wherein the cross-sectional shape is defined by a top surface, a bottom surface, a front surface and a back surface formed by the four members, further comprising at least one gap in at least one of these surfaces between at least two of the four members.

6. The adjustable snowplow of claim 5, wherein the at least one gap further comprises at least one of:

a top gap formed in the top surface between the top front member and the top back member;

a bottom gap formed in the bottom surface between the bottom front member and the bottom back member;

a front gap formed in the front surface between the top front member and the bottom front member proximate to the center blade;

a back gap formed in the back surface between the back top member and the back bottom member opposite the center blade;

wherein the top gap, the bottom gap, the front gap, and the back gap permit snow and water to fall and/or flow away from the adjustable snowplow.

7. The adjustable snowplow of claim 4, wherein the four members of the channel are L-shaped angle iron components.

8. The adjustable snowplow of claim 4, wherein the first and second wing bars are hollow with a generally rectangular cross-sectional shape respectively having four sides.

9. The adjustable snowplow of claim 4, wherein at least one of the four sides of the rectangular cross-sectional shape of the first and second wing bars comprise at least one opening to permit snow and water to fall and/or flow away from the adjustable snowplow.

10. The adjustable snowplow of claim 1, further comprising at least one support arm for interconnecting at least one of the first and second wing blades to a respective one of the first and second wing bars.

11. The adjustable snowplow of claim 10, wherein a relatively inner support arm is shorter than a relatively outer support arm so that the first and second wing blades are at an angle with respect to the center blade.

12. The adjustable snowplow of claim 11, further comprising open spaces between the relatively inner support arm and the relatively outer support arm, to provide additional space to permit snow and water to fall and/or flow away from the adjustable snowplow.

13. An adjustable snowplow, comprising:

a center blade and first and second wing blades each positioned on opposite ends of the center blade;

a channel running longitudinally along a back of the center blade, substantially along a length of the center blade;

first and second wing bars attached to respective backs of the first and second wing blades, wherein the first and second wing bars are configured to be slidably received within the channel for reciprocal movement so that at least one of the first and second wing blades are moved inwardly toward the center blade or moved outwardly away from the center blade, thereby adjusting an overall width of the snowplow;

wherein the channel comprises a cross-sectional shape defined by a plurality of surfaces, and further comprising at least one gap formed in at least one of the plurality of surfaces, to permit snow and water to fall and/or flow through the gap and away from the adjustable snowplow;

wherein the cross-sectional shape of the channel is a generally is a generally rectangular cross-sectional shape defined by four surfaces formed by four members comprising a top front member, a top back member, a bottom front member, and a bottom back member;

wherein the four members of the channel are L-shaped angle iron components; and further comprising:

at least one attachment component for attaching the center blade to a vehicle.

14. An adjustable snowplow, comprising:

a center blade and first and second wing blades each positioned on opposite ends of the center blade;

a channel running longitudinally along a back of the center blade, substantially along a length of the center blade;

first and second wing bars attached to respective backs of the first and second wing blades, wherein the first and second wing bars are configured to be slidably received within the channel for reciprocal movement so that at least one of the first and second wing blades are moved inwardly toward the center blade or moved outwardly away from the center blade, thereby adjusting an overall width of the snowplow;

wherein the channel comprises a cross-sectional shape defined by a plurality of surfaces, and further comprising at least one gap formed in at least one of the plurality of surfaces, to permit snow and water to fall and/or flow through the gap and away from the adjustable snowplow;

wherein the first and second wing blades are each fixed at an obtuse angle with respect to the center blade;

at least one attachment component for attaching the center blade to a vehicle; and at least one support arm for interconnecting at least one of the first and second wing blades to a respective one of the first and second wing bars, wherein a relatively inner support arm is shorter than a relatively outer support arm so that the first and second wing blades are maintained at their respective obtuse angles with respect to the center blade.

15. The adjustable snowplow of claim 14, further comprising open spaces between the relatively inner support arm and the relatively outer support arm, to provide additional space to permit snow and water to fall and/or flow away from the adjustable snowplow.

* * * * *